United States Patent [19]

Holbert

[11] 4,420,049

[45] Dec. 13, 1983

[54] DIRECTIONAL DRILLING METHOD AND APPARATUS

[76] Inventor: Don R. Holbert, 6637 W. Hinsdale Ave., Littleton, Colo. 80123

[21] Appl. No.: 396,248

[22] Filed: Jul. 8, 1982

Related U.S. Application Data

[63] Continuation-in-part of Ser. No. 158,237, Jun. 10, 1980, abandoned.

[51] Int. Cl.[3] ..... E21B 7/08

[52] U.S. Cl. ..... 175/45; 175/61; 175/82

[58] Field of Search ..... 175/82, 83, 45, 61

[56] References Cited

U.S. PATENT DOCUMENTS

| | | | |
|---|---|---|---|
| 1,595,977 | 8/1926 | Prindle | 175/79 |
| 2,131,849 | 10/1938 | Tolson | 175/45 |
| 2,544,982 | 3/1951 | Buttolph | 175/82 |
| 2,669,428 | 2/1954 | Zublin | 175/61 |
| 2,953,350 | 9/1960 | Moore | 175/45 |
| 3,116,799 | 1/1964 | Lemons | 175/61 |
| 3,225,830 | 12/1965 | Livingston | 175/45 |
| 3,349,845 | 12/1965 | Holbert et al. | 166/271 |
| 3,398,804 | 8/1968 | Holbert | 175/61 |

*Primary Examiner*—Ernest R. Purser
*Assistant Examiner*—Michael Starinsky
*Attorney, Agent, or Firm*—John E. Reilly

[57] ABSTRACT

Directional drilling is carried out by orienting and positioning a whipstock having a curved guide surface at a predetermined rotational angle with respect to the desired azimuth so as to compensate for lateral deviation of the original bore or rathole. The curved guide surface of the whipstock is given a radius of curvature in a longitudinal direction corresponding to that of the drainhole section radius and is provided with a concave face in a transverse direction which defines lateral wings along the guide surface to control the advancement of the drilling tool along the desired course and avoid objectionable helixing. Proper orientation and guidance of the drill tool by means of the radius whipstock as described permits accurate determination of the drainhole orientation vertical drill distance between the zenith and nadir of the drainhole as well as the actual drilled depth between those points.

15 Claims, 15 Drawing Figures

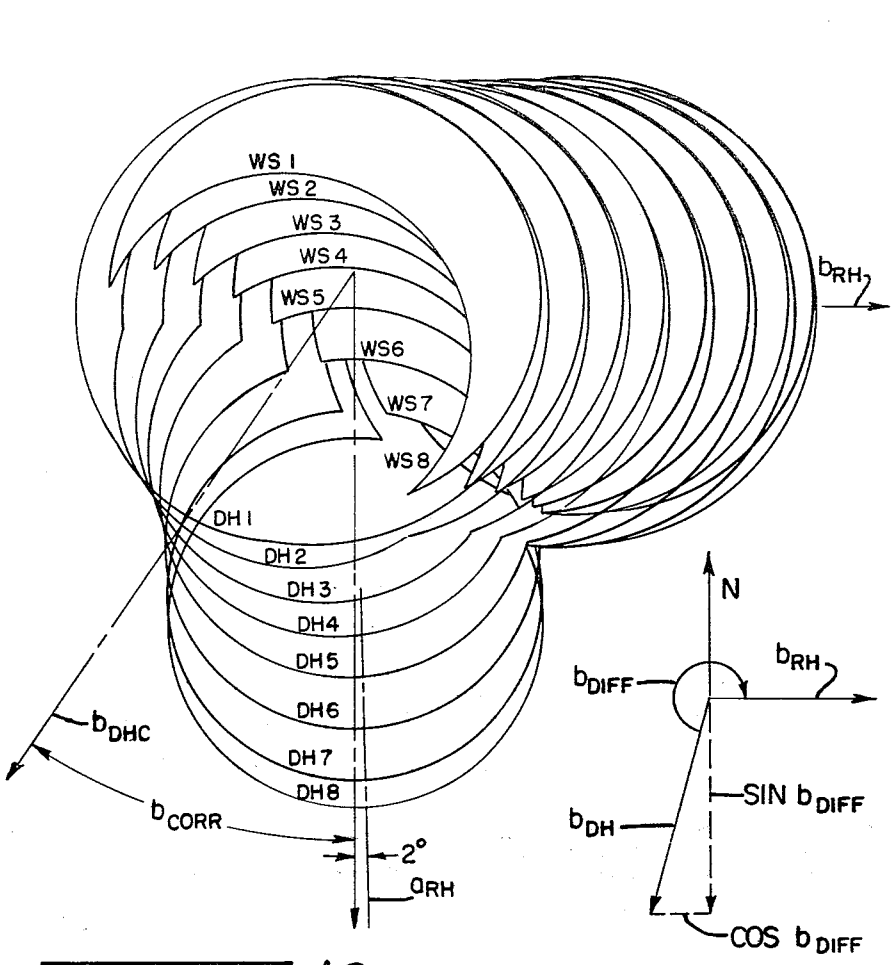
FIG. 12
FIG. 12A
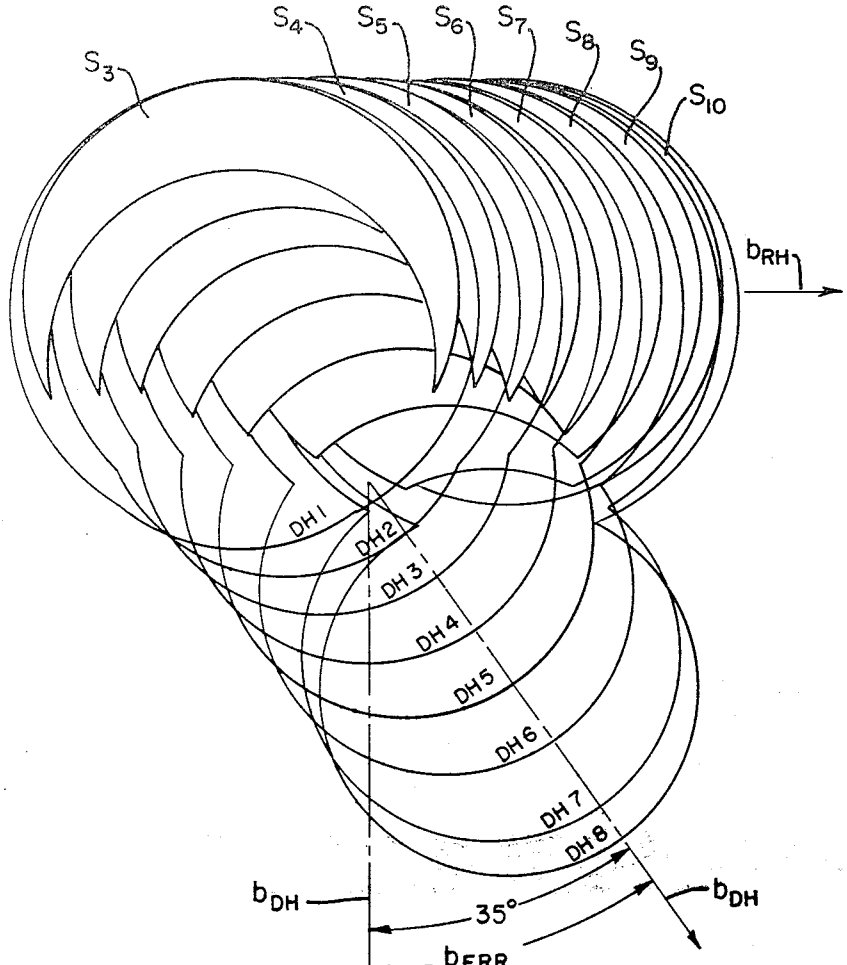
FIG. 11

DIRECTIONAL DRILLING METHOD AND APPARATUS

This application is a continuation-in-part of my copending application, Ser. No. 158,237, filed June 10, 1980 now abandoned for DIRECTIONAL DRILLING METHOD AND APPARATUS.

This invention relates to a novel and improved method and apparatus for directional drilling; and more particularly relates to a novel and improved radius whipstock apparatus and a method of orienting such apparatus for drilling along the proper azimuth in drainhole drilling operations.

BACKGROUND AND FIELD OF THE INVENTION

In the drilling of wells, for example, in the recovery of oil and gas from subsurface formations, it is very often necessary to depart from the vertical or main well bore by drilling a generally horizontal bore which is initiated along a curved section radius away from the main bore, this curved section radius being customarily referred to as a drainhole. For this purpose, various types of whipstocks have been devised which provide a generally angular guide surface to direct the drill bit in the desired direction or azimuth away from the vertical bore. Ordinarily, whipstock employed for the purpose of drainhole drilling operations may have angled guide surfaces which vary anywhere from 1° to 20° depending upon the degree of curvature desired. For instance, reference is made to U.S. Pat. Nos. 3,398,804 and 3,349,845 granted to me as an inventor and co-inventor, respectively, for a description of drainhole drilling operations employing standard whipstocks. The whipstocks in the methods described in my hereinbefore referred to patents are entirely satisfactory for drilling drainholes where the original or main bore does not deviate from vertical. However, it is very difficult under actual practice to drill a perfectly straight hole; and most oil, gas or water wells of any depth have a significant amount of deviation. It has been found that when the original bore deviates in a lateral or perpendicular direction to any appreciable extent away from the desired drainhole direction of azimuth, under typical drainhole drilling conditions, the standard whipstock will lose its ability to control the direction of drilling and fail to induce curvature development along the proper plane away from the original bore. For instance, if the normal component of deviation is even as low as 1° away from vertical, an error of 10° to 15° in drainhole orientation may be introduced.

It has been proposed in the past to construct whipstocks with a curved guide surface which approximates the curved section radius of the drainhole to be drilled through a lateral wall of the original bore. For example, this was generally suggested in my hereinbefore referred to patents. Others have also made reference to the use of curved or radius whipstocks in drainhole drilling operations. Representative patents are U.S. Pat. Nos. 1,595,922 to O. C. Prindle; 2,158,329 to F. Kinzbach; 2,642,267 and 2,669,428 to J. A. Zublin; 2,709,070 to W. J. Bielstein; 3,116,799 to R. Lemons; and 3,282,355 to J. K. Henderson. However, there has been notably lacking in the past any recognition of the problem of correcting or compensating for lateral deviation of the original hole away from vertical either in the design of the whipstock guide surface or in the method of orientation of the whipstock guide surface with respect to initiation of the curved section radius of drainhole along the proper azimuth.

SUMMARY OF THE INVENTION

It is therefore an object of the present invention to provide for a novel and improved method and apparatus for directional drilling in a desired direction from the original bore where the original bore deviates or departs from vertical.

It is another object of the present invention to provide for a novel and improved whipstock which tolerates maximum wellbore deviation in drilling drainholes therefrom while avoiding undue stress imposed on the drilling apparatus.

A further object of the present invention is to provide for a novel and improved method for orienting a drilling apparatus in the proper direction by determining the extent of hole enlargement and deviation which can be tolerated before successful takeoff or desired drainhole orientation can be achieved.

A preferred form of the present invention resides in the construction of a radius whipstock so as to correct or compensate for undesirable lateral deviation in the rathole in controlling the direction of the drill bit in drainhole drilling operations while inducing the proper curvature development of the drainhole in an effort to approach a vertical plane. In accordance with the present invention, a radius whipstock is formed with a curved guide surface having a predetermined radius of curvature corresponding to the drainhole curved section radius. Moreover, the guide surface of the whipstock is formed with a concave face in a direction transversely of the length of the guide surface, which concave face is on a predetermined radius sufficient to form lateral guide wings bordering opposite sides of the guide surface which will cooperate in maintaining the drainhole drilling apparatus in a predetermined plane once the whipstock is properly oriented in the hole with respect to the desired azimuth. Essential to the development of the proper drainhole curved section radius and the initiation of the drainhole along a predetermined course is that the whipstock guide surface be formed along a predetermined radius of curvature both in the longitudinal and transverse directions. The known curvature of the whipstock as described is able in certain cases to correct for deviation of the original hole so as to permit drilling of a drainhole in the desired direction from the zenith or starting point of the drainhole to the nadir or termination of the drainhole. In order to calculate the radius whipstock orientation, a downhole surveying instrument is employed in a conventional manner to determine the direction and extent of angular deviation from vertical of the rathole, this angle being referred to as the drift angle. The angle which is formed between the direction of deviation and the desired direction or bearing of the hole may be divided into its normal and parallel components, or unit vectors, by taking the sine and cosine of the angle. The procedure which is then followed to determine the correction angle for the drainhole is to compute the course which the drainhole drilling apparatus must follow for a given radius whipstock and known lateral deviation in order to reach a predetermined point of termination. In the development of the drainhole, the drilling apparatus will follow a generally helical course or twisted curve; and in actual practice, the path of the helix can be most economically determined by a combination of calculation and graphical means for a predetermined radius of curvature of the whipstock and the normal component of the deviation of the rathole from vertical. Field experience has shown that in many cases the twisted curve is a helix that degenerates into a circular arc in nearly the identical direction the whipstock is faced, thereby minimizing the need for azimuth correction.

When it becomes necessary to make arc azimuth correction, the correction angle for proper orientation of the whipstock will be in an opposite direction to the normal component of the deviation of the rathole and, for a given angle of build, will approximate a predetermined number of degrees for each degree of lateral deviation. For instance, where the radius of curvature of the radius whipstock is 11.5 feet, the correction angle will approximate 4° for each degree of lateral deviation without taking into account any helixing of the drilling apparatus.

Once the normal component of the main bore hole deviation has been determined with respect to the desired drainhole orientation, the true vertical distance from the start of drainhole curvature, or zenith, to the point at which the drainhole becomes horizontal, or nadir, can be determined from the vertical component of distance required to achieve the turn from vertical to horizontal for a given normal component of deviation and the angle building capacity of the radius whipstock. This vertical distance must then be corrected for the component of main bore hole deviation from vertical depending upon whether it is in the same or opposite direction to the desired drainhole azimuth. Thus, if the in-line component is in the same direction as the desired drainhole azimuth, the true vertical distance will be reduced, but if it is in the opposite direction it will be increased by an amount proportional to the in-line component of the deviation multiplied by a factor inversely proportional to the angle building capacity of the tool.

It is equally important to determine the actual drilled depth of the hole so as to assure that the drainhole is not overdrilled past 90° or underdrilled less than 90° from vertical. If the drainhole is overdrilled excessively, it may not be possible to have any significant length of the drainhole within the vertical target limits. On the other hand, if the hole is underdrilled, it may be necessary to rerun the angle building tools and continue drilling the required additional distance. Accordingly, the actual drilled depth or length required to reach the nadir can be plotted based on a knowledge of the correction angle and vertical distance for a given angle building capacity of the radius whipstock and the bottom hole drilling assembly. The resultant distance must again be corrected for the in-line component of the main well bore deviation with respect to the desired azimuth, this distance being proportional to the in-line component and inversely proportional to the angle of build of the drilling tool assembly. This correction is added if the in-line well bore deviation is opposite to the desired drainhole direction, but is subtracted if the in-line component is in the same direction as the desired drainhole direction. This will enable determination of the correct distance at which drilling should be stopped so that the drainhole is at 90° to vertical. At that point, the angle building drill assembly can be withdrawn, a stabilizer assembly run and the straight, in-line portion of the drainhole is then completed.

The above and other objects, advantages and features of the present invention will become more readily understood and appreciated from a consideration of the following detailed description of a preferred embodiment of the present invention when taken together with the accompanying drawings in which:

BRIEF DESCRIPTION OF THE DRAWINGS

FIG. 11 is a somewhat diagrammatic view illustrating the unwanted deviation or deflection in a drainhole when not properly oriented to compensate for lateral deviation of the original bore in a subsurface formation;

FIG. 12 is a somewhat diagrammatic view illustrating proper orientation of the radius whipstock to compensate for lateral deviation of the original hole;

FIG. 12A is a plan view of the specific angles and compass directions involved in making a determination of the whipstock correction angle;

DETAILED DESCRIPTION OF THE PREFERRED EMBODIMENT

Figure 1:
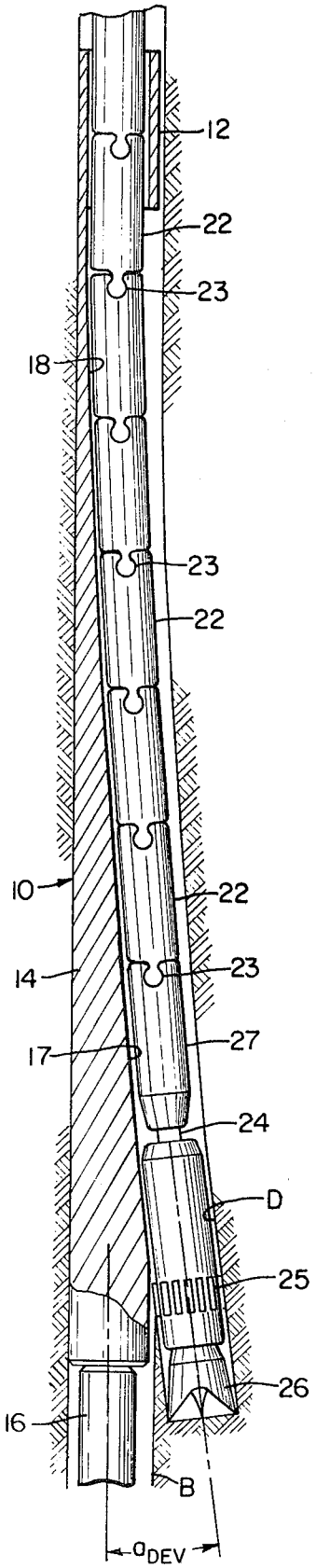
FIG. 1 is a longitudinal cross-sectional view of a preferred form of radius whipstock assembly and illustrating the initiation of the drainhole by a conventional form of reamerbit assembly.
Figure 2:
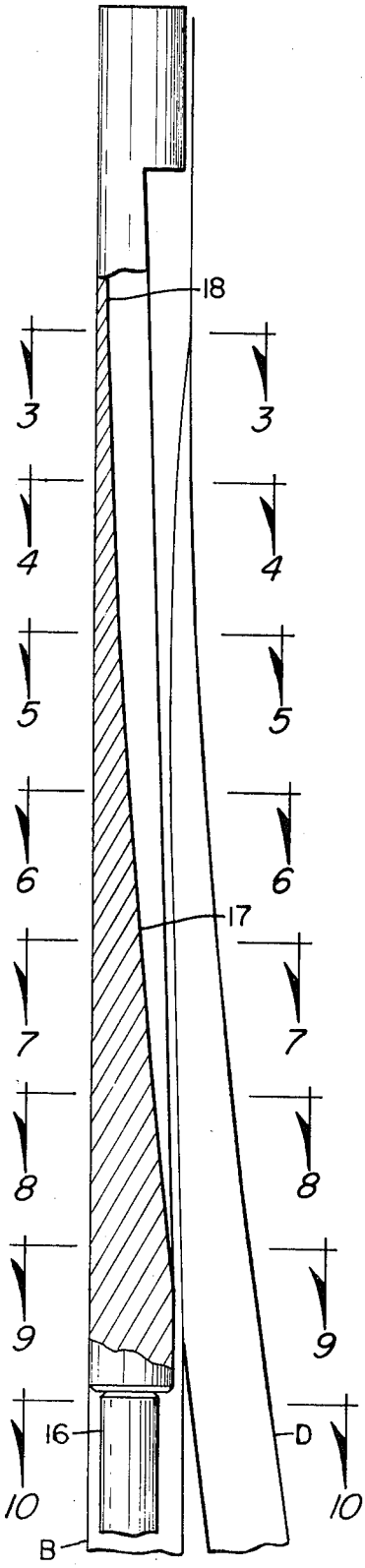
FIG. 2 is an enlarged view partially in section similar to FIG. 1 and illustrating in more detail the construction and arrangement of the curved guide surface of the radius whipstock.
Figure 13:
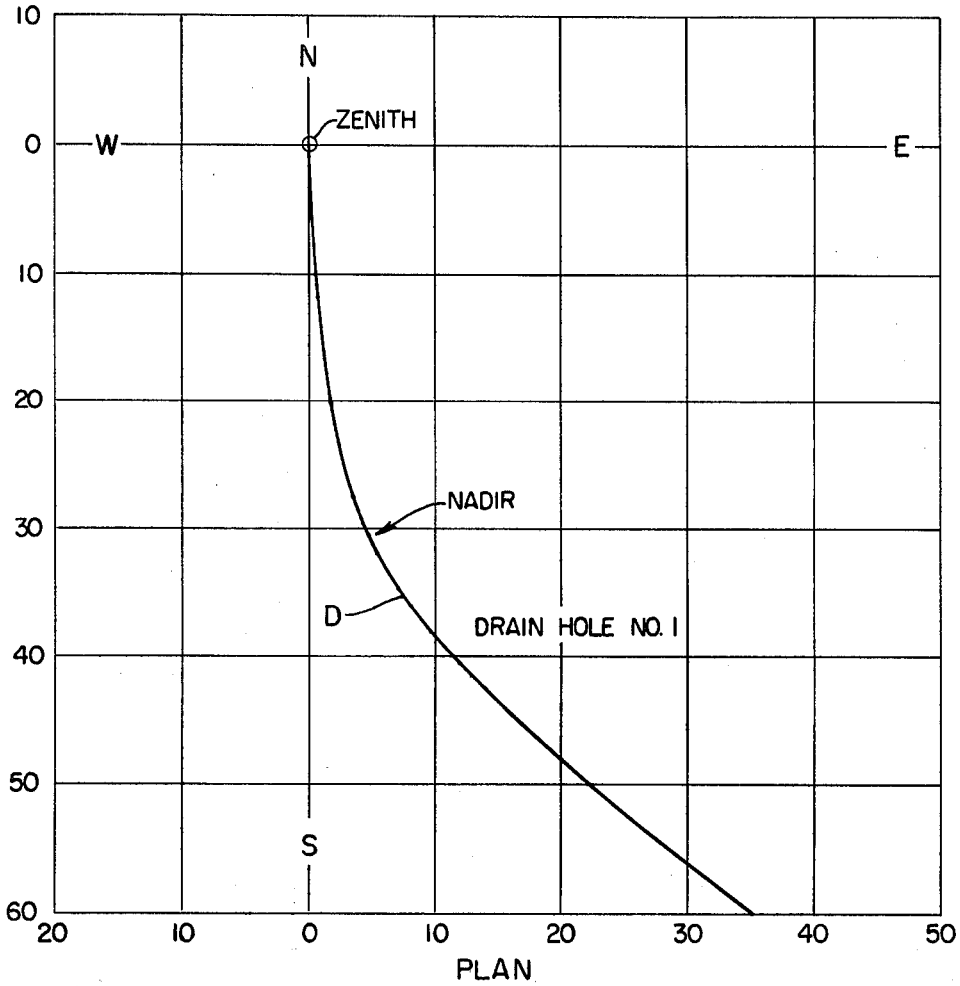
FIG. 13 is a plan view illustrating the curvature formed in a typical drainhole and extending from the zenith to the nadir of the drainhole.
Figure 14:
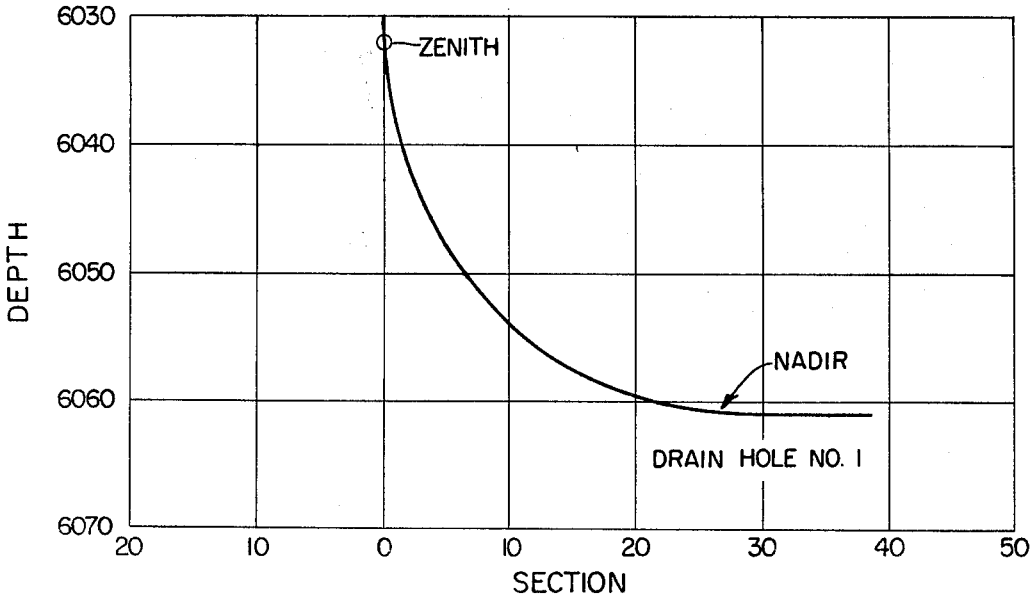
FIG. 14 is a longitudinal sectional view plotting the course taken by the drainhole illustrated in FIG. 13 between the zenith and nadir of the drainhole.

Referring in detail to the drawings, there is illustrated in FIG. 1 a directional drilling apparatus for drilling a drainhole D in a generally lateral direction away from the main, generally vertical well bore B. After the main well bore B is drilled into the subsurface formation, the lateral bore is drilled from a predetermined depth away from the main bore in a desired direction or bearing, for example, as illustrated in the diagrammatic views of FIGS. 13 and 14. As seen from the plan and sectional views of FIGS. 13 and 14, the lateral bore will undergo or follow a generally helical course of travel in advancing from the zenith or point of initiation from the main bore to its nadir or termination point. It should be recognized that the nadir is a known depth and direction away from the original bore, and in directional drilling operations, it is extremely important that the drainhole be initiated and drilled along a predetermined course or direction and with a predetermined radius of curvature so that its termination point or nadir can be accurately predicted and reached upon completion of drilling.

In the accomplishment of the foregoing, as shown in FIG. 1, a preferred form of radius whipstock assembly 10 is defined by an upper tubular end or sheaf 12 and a main, elongated body 14 of generally cylindrical configuration, and an anchor assembly 16 is affixed at the lower end of the main body. An important feature of the present invention resides in the formation of a curved guide surface 17 in the main body 14, the curved guide surface 17 extending for the greater length of the body so as to diverge downwardly from an upper, slender tapered end 18 and to terminate at the outer wall of the main body radially opposite to the end 18 but at the lower end of the main body 14 directly above the anchor 16. The anchor assembly 16 is of any suitable construction and, in accordance with well-known practice, is dimensioned to be of a length so that, when positioned on the whipstock assembly 10, it can be set in the bottom of the main bore with the radius whipstock and specifically the curved guide surface 17 at the desired height to initiate drilling of the drainhole D laterally from the main bore B. In the present invention, the curved guide surface 17 is given a radius of curvature in a longitudinal or axial direction corresponding to the desired drainhole section radius of curvature; and in a transverse direction the whipstock is given a radius of curvature corresponding substantially to or slightly less than the radius of the body 14 or sheath 12 so as to define laterally projecting wings 20 on opposite sides of the guide surface, as best seen from the cross-sectional views of FIGS. 3 to 10.

The directional drilling apparatus may comprise a conventional assemblage of elements and, for example, as illustrated in the preferred form of invention, is made up of sections of drill pipe 22 interconnected by universal joints 23, and a knuckle joint 24 at the lower end of the drill pipes is connected to a reamer 25 having a drill bit 26 at its lower extremity. The drill pipe sections 22 are capable of undergoing a limited degree of lateral movement so as to be able to follow the drill bit 26 along the predetermined radius of curvature established by the curved guide surface 17 of the whipstock as the drill bit 26 is advanced laterally from the main bore B. Similarly, the sections 22 and universal joint 24 impart the necessary rotation into the reamer 25 and drill bit 26, all in accordance with well-known practice. The drill bit 26 also may be of conventional construction and for example may be a rock drill having rotary cutting elements, while the reamer 25 serves to follow the drill bit in forming the lateral bore or drainhole and to ream out the bore as it is formed.

As a preliminary to insertion of the directional drilling apparatus as described into the well bore, the radius whipstock 10 and anchor 16 are connected with standard drill pipe, this being accomplished, for example, by means of a frangible pin, not shown, interconnected between the upper sheath 12 and a latch and orientation sub, not shown, connected to drill collars and drill pipe in a conventional manner. The position of the pin is such as to hold the whipstock assembly with a latch which can be released when the frangible pin is broken by setting a substantial portion of drill collar weight down upon the whipstock and anchor assembly. The latch, orientation sub, drill collars and drill pipe are then removed from the well leaving the whipstock assembly in place. Most desirably, a slip assembly, not shown, is also positioned on the upper sheath to firmly anchor the upper sheath 12 in position at the bottom of the main bore so as to prevent its displacement once properly oriented or positioned in the main bore in a manner to be hereinafter described. Again, the distance of the directional drilling apparatus above the bottom of the main bore is determined by the length of the anchor. Of particular importance however is the proper orientation or correction angle of the radius whipstock; that is, the placement or disposition of the radius whipstock in the desired compass direction so as to compensate for any lateral deviation of the main bore away from vertical.

As a preliminary to describing the proper facing or correction angle of radius whipstock 10, an important factor is a determination of the radius of curvature or angle of build of the guide surface 17 which will in turn establish the desired curved section radius of the drainhole itself and the correction required for each degree of lateral deviation. For extreme deviation of the nadir away from the original bore in the absence of any helixing or twist imparted by the radius whipstock to the drilling apparatus, the curvature or angle of build is most desirably greater, for example, on the order of 5° per foot, and the correction angle would be less while the drainhole itself would be formed along a radius of curvature of 11.5′, as set forth in the following table:

| Angle of Build | Correction Angle Per Degree of Lateral Deviation | Radius of Curvature of Drainhole |
|---|---|---|
| 5°/ft. | 4° | 11.5′ |
| 3°/ft. | 6° | 19′ |
| 1.5°/ft. | 8° | 39′ |

Another important factor in the selection or sizing of the equipment is to ascertain that the main borehole is very close in diameter to that of the whipstock. Furthermore, the lateral or transverse radius of curvature of the curved guide surface, for example as viewed in FIGS. 3 to 10, should correspond substantially to that of the inner diameter of the sheath 12. Moreover, the vertical length of the whipstock surface is determined according to the following formula:

$$\sqrt{2 \cdot R \cdot (D_{WS} - h_{wt}) - (DWS - h_{wt})^2}$$

where R=Radius of Curvature; DWS=Outside Diameter of Whipstock; and $h_{wt}$=Wall Thickness of Whipstock.

Figure 3:
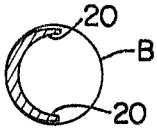
FIGS. 3 to 10 are cross-sectional views taken about lines 3—3 through 10—10, inclusive, of FIG. 2.
Figure 4:
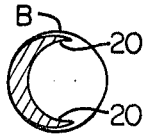
Figure 5:
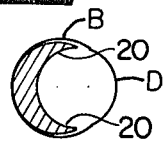
Figure 6:
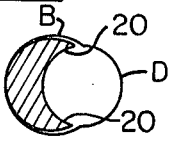

FIGS. 3 to 10 illustrate the manner in which the whipstock operates by forcing the drill bit 26 to initiate a drainhole through the wall of the main borehole. FIG. 3 illustrates the initial take-off from a 5.5″ outside diameter 38′ radius whipstock 10 in a 6″ hole. At FIG. 3, the bit 26 is at a point just contacting the wall of the main borehole B. FIGS. 4 and 5 illustrate the drainhole increasing in sectional size as the bit advances along a guide surface 17. At FIG. 6, it will be seen that the section of the drainhole D has just increased in size to be greater than 180°. This is a critical section in that beyond this point the reamer 25 can be supported by the rock or subsurface formation, and the lateral wings 20 of the guide surface have tapered to a point where they are substantially less than 180° so as not to afford the same degree of lateral support. Thus if the main borehole is overly large with respect to the size of the whipstock, the point illustrated at FIG. 6 may not be achieved before the bit 26 has reached the end of the guide surface and proper take-off will not occur. Instead, the drilling assembly may tend to steeply helix or corkscrew around the anchor instead of developing curvature in a substantially vertical plane.

Figure 7:
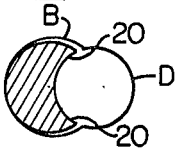

In FIG. 7, the drainhole has continued its departure from the main borehole B so as to close the gap at its lower side. It is important that this gap be closed sufficiently before the guide surface ends so that the joints 23 in effect will be lifted into the drainhole without disturbing orientation of the directional drilling assembly. If this is not done, the joints 23 would steer the directional drilling assembly 10 over to one side or another of the whipstock, and steep and undesirable helixing may again occur.

Figure 8:
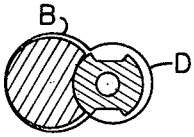
Figure 9:
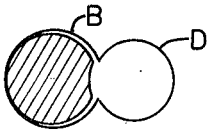
Figure 10:
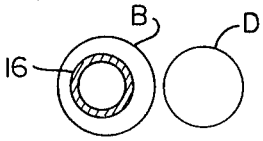

FIGS. 8, 9 and 10 illustrate progressive development of the drainhole to a point at which the drainhole has a full circumference, as illustrated at FIG. 10, which is spaced from the main borehole and will continue its development along the curved section radius as established initially by the guide surface 17. The development of the drainhole in this manner may be better appreciated from a consideration of FIG. 14 which is a longitudinal cross-section diagrammatically showing the radius of curvature of the drainhole D to the desired depth or nadir.

From a consideration of FIG. 11, a series of sections corresponding to those illustrated in FIGS. 3 to 10 are illustrated of the curved guide surface 17 in closely spaced series but offset with respect to one another as a result of lateral deviation of the bore hole away from vertical. Thus, if the desired azimuth or bearing of the drainhole as represented at $b_{DH}$ were to extend in the direction as illustrated, but the rathole or original borehole B extends at a 90° angle with respect to the desired azimuth, as represented at $b_{RH}$, the sections of the curved guide surface, as designated at $S_3$ through $S_{10}$ in FIGS. 3 to 10, would assume the essentially offset relationship as illustrated in FIG. 11 if the guide surface were merely aligned with the desired azimuth or bearing. The net effect would be to cause the directional drilling apparatus to be deflected in the direction as designated at $b_{ERR}$ away from the desired direction of the drainhole and would result in a substantial departure away from the desired termination point of the drainhole. It is therefore highly important that the whipstock guide surface 17 be corrected by an angle $b_{CORR}$, as shown in FIG. 12, or faced in a direction to compensate for the deviation of the main borehole and to assure that the drainhole will intersect the desired azimuth or bearing of the drainhole when it reaches its maximum drill depth or termination point. As a preliminary to a discussion of determination of the desired whipstock correction angle, it should first be recognized that the whipstock must be designed with a curvature close to or identical to the drainhole curved section radius. Otherwise, if a straight whipstock face were employed having no relationship to the drainhole curved section radius, it would be incapable of adequately closing the drainhole in order to properly lift the joints 23 and maintain the steering of the directional drilling apparatus in the proper plane; also, the short travel distance of the whipstock would be insufficient to establish any significant vertical curvature or to develop sufficient horizontal curvature to combat very much hole deviation. Deviations greater than 1°–2° are the general rule in wells drilled deeper than 1,000'. It is therefore important that the whipstock be provided with a predetermined radius of curvature along its guide surface so as to minimize adverse effects which would otherwise occur when the whipstock were corrected to compensate for undesirable deviation of the main bore. Thus, in forming the drainhole the radius whipstock will follow the curvature of the drainhole instead of departing in a tangent line and thereby will provide sufficient support for the reamer 25 and joint 23 until the unsymmetrical wings 20 are able to develop sufficiently to carry their portion of the joint force.

The facing of the whipstock at the proper correction angle can be best understood from a consideration of FIG. 12. As illustrated in FIGS. 11, 12 and 12A, the reference characters illustrated have the following meanings:

DH—azimuth or bearing of proposed drainhole (compass reading in degrees from true North)

$b_{RH}$—azimuth or bearing of rathole in which whipstock is placed (compass reading in degrees from true North)

$b_{DIFF}$—the difference between $b_{DH}$ and $b_{RH}$ measured in degrees clockwise from $b_{DH}$ $b_{ERR}$—the error in azimuth angle that is caused by lateral or normal deviation of the rathole with respect to the desired drainhole azimuth $b_{CORR}$—the correction in azimuth to compensate for lateral or normal deviation of the rathole angle $a_{RH}$—the angle of lateral deviation from vertical of the rathole or main bore B $a_{RHNDC}$—the normal component of $a_{RH}$ to the proposed drainhole ($a_{RHNDC}=a_{RH} \sin b_{DIFF}$)

$a_{DHDC}$—the in-line component of the rathole drift angle $a_{RH}$ ($a_{DHDC}=a_{RH} \cos b_{DIFF}$)

$a_{DEV}$—the departure from vertical of the drainhole well course beyond the end of the whipstock in a direction in-line with the desired azimuth (as represented in FIG. 1)

It will be evident from a consideration of FIGS. 12 and 12A that if there is no lateral deviation in the original bore B, the whipstock may be faced or aligned directly in-line with the desired azimuth; or in other words, no correction angle is required to compensate for lateral deviation. In that case, it becomes necessary only to determine $a_{DEV}$ for the known radius of curvature of the whipstock, the distance or drilled depth between the zenith and nadlr, and the in-line deviation of the original bore B with respect to vertical. Thus, the departure angle $a_{DEV}$ would in effect be the tangent to the curved guide surface of the whipstock at its lower end. However, if from surveying of the original bore B, it is determined that there is a drift or lateral deviation of the hole from vertical, the angle $a_{RH}$ which is formed between the direction of deviation and the desired direction of the hole is divided into its normal and parallel or in-line components by taking the sine and cosine of that drift angle, as illustrated in FIG. 12A. The procedure then followed to determine the whipstock correction angle is to compute the course which the drainhole drilling apparatus must follow for a known radius of curvature of the whipstock guide surface 17 and the normal component of the drift angle necessary to reach a predetermined point of termination or nadir.

The whipstock correction angle $b_{CORR}$ will be in a direction away from the desired azimuth which is opposite to the normal component of the drift angle and, for a known radius of curvature of the guide surface, will approximate anywhere from zero to a predetermined number of degrees for each degree of lateral deviation. The true vertical distance from the zenith to the nadir can be determined from the vertical component of distance necessary to cause the drainhole to advance into a horizontal plane for a given normal component of the drift angle and the known radius of curvature of the guide surface 17. The vertical distance must be corrected for the in-line component of the main borehole deviation from vertical depending upon whether it is in the same or opposite direction to the desired drainhole azimuth. Thus if the in-line component is in the same direction as the desired drainhole azimuth, $b_{DH}$, the true vertical distance will be reduced; conversely, if it is in the opposite direction, the true vertical distance will be increased by an amount proportional to the in-line component. The amount of increase or decrease is then multiplied by a factor inversely proportional to the radius of curvature of the guide surface 17. It is equally important to determine the actual drilled depth of the hole to assure that the drainhole is not drilled past 90° or less than 90° from vertical in reaching the desired termination point. The actual drilled depth can be plotted based on a knowledge of the correction angle for the whipstock and the true vertical distance with a further correction for the in-line component of deviation of the main bore B from vertical. Generally, the drilled depth will be proportional to the in-line component of deviation and inversely proportional to the radius of curvature of the guide surface 17, this correction being added if the in-line component is opposite to the desired drainhole direction and subtracted if it is in the same direction as the desired drainhole.

From the foregoing, the drill string can be positioned in the main bore B and the anchor is set such that the face of the whipstock is oriented at an angle or direction to compensate for the direction of lateral deviation of the main bore away from the desired azimuth of the lateral bore or drainhole and at a correction angle $b_{CORR}$ necessary to cause the directional drilling apparatus to follow a predetermined course in reaching the desired termination point. Once anchored and the slip assembly set as described earlier, the directional drilling apparatus can be introduced and advanced along the curved guide surface 17 of the whipstock to drill the drainhole along the predetermined curved section radius. As will be seen from a consideration of FIGS. 13 and 14, the curved section radius will describe or follow a path as illustrated in the plan view of FIG. 13 and the vertical section view of FIG. 14 until it reaches the desired termination point or nadir designated at N. The whipstock assembly is then withdrawn and a stabilizer assembly run for completion of the straight, in-line portion of the drainhole.

FIG. 12 illustrates the effect of introducing the proper correction angle into the facing of the whipstock together with building into the whipstock a known radius of curvature both in the longitudinal and transverse directions but without taking into account the helixing component. Again a series of sections corresponding to FIGS. 3 to 10 are illustrated in contiguous relation to one another to illustrate the whipstock facing at the required correction angle to compensate for lateral deviation of the main bore. As the drill bit 26 advances along the curved guide surface, the face of the whipstock will initiate a drainhole along a predetermined course which will cause the drill bit to gradually return into a direction along the desired azimuth as represented at $b_{DH}$. Specifically, in FIG. 12, the orientation or correction angle of the whipstock has been determined to be 26° in a direction clockwise from the desired azimuth for a lateral deviation of 2° of the main bore B in a counterclockwise direction away from the desired azimuth.

It is important to recognize that the radius whipstock assembly may introduce a twist or helix into the drilling apparatus as it proceeds beyond the whipstock and in a direction which can tend to cause the course of the drainhole to return to the whipstock facing azimuth. The helix component may be evaluated graphically and an additional suitable correction made for this component in order to determine the azimuth, drilled depth and vertical depth at the point where the drift angle is 90° to vertical. Generally, the parameters necessary to calculate a well or drainhole course must be determined starting from the zenith to the point either where the drainhole azimuth returns to the whipstock facing azimuth or when it reaches the nadir before it can complete the return. These values are integrated with the measurement of the depth from the whipstock to the point at which the drainhole course becomes parallel to the whipstock facing along with the drift angle at that point. The values for the nadir point are relatively straightforward since the drift angle is 90° and the direction angle is the same as the whipstock facing. It is necessary to calculate the drilled distance to the 90° point from the parallel course point from a knowledge of the angle build that will be drilled by the angle building or whipstock assembly. Finally, the well course is calculated by one of the known commputational techniques, such as, the helical or radius of curvature method so that the necessary correction or compensation can be made for the helix component as well as in-line deviation of the main borehole in determining the correction angle required; and in many cases, proper selection of the radius of curvature of the radial whipstock assembly will introduce a helixing component into the drilling apparatus such that the correction angle can be greatly minimized, if not eliminated.

Accordingly, there is set forth and described herein a novel and improved form of whipstock apparatus which will tolerate maximum wellbore deviation in drilling drainholes while avoiding undue stress on the directional drilling apparatus. This is employed in conjunction therewith a procedure which will permit accurate plotting of the desired drainhole orientation by calculating the correction angle required in the whipstock while assuring that even for substantial angles of deviation the directional drilling apparatus can successfully take off from the main bore into the lateral bore or drainhole without excessive helixing.

It is to be understood that while a preferred method and apparatus has been described for directional drilling, that various modifications and changes may be resorted to without departing from the scope of the present invention as defined by the appended claims.

I claim:

1. A method of directionally drilling a bore in a lateral, downwardly curved direction away from a substantially vertical main bore in a subsurface formation, comprising the steps of:

determining the deviation of the main bore from vertical;

positioning a drill string in the main bore having a whipstock with a curved guide surface at the lower end of said drill string, said curved guide surface having a radius of curvature in a longitudinal direction corresponding to the radius of curvature of the lateral bore to be formed and having a concave face in a transverse direction;

orienting said whipstock at a correction angle to compensate for lateral deviation of the main bore away from the desired azimuth of said lateral bore and helixing of a drill bit as it is advanced beyond said whipstock in forming a lateral bore, and anchoring said whipstock in the oriented position at said correction angle so as to compensate for any lateral deviation of said main bore, followed by advancing a drill bit along the curved guide surface to drill the lateral bore along the predetermined radius of curvature.

2. The method according to claim 1, including the step of correcting the orientation of the whipstock on the order of 6° for each degree of lateral deviation where the angle of build of said curved guide surface is on the order of 3° per foot.

3. The method according to claim 1, wherein the curvature of the concave face of the guide surface in a transverse direction corresponds to the radius of curvature of the drill string.

4. The method according to claim 3, characterized by drilling from the main bore for a vertical distance corrected by the in-line component of deviation of the main bore from vertical.

5. The method according to claim 3, in which the curved guide surface of the whipstock is substantially of a vertical length equal to $$\sqrt{2 \cdot R \cdot (D_{WS} - h_{wt}) - (DWS - h_{wt})^2}$$

where R=Radius of Curvature; DWS=Outside Diameter of Whipstock; and $h_{wt}$=Wall Thickness of Whipstock.

6. In the method of drilling a drainhole along a predetermined radius of curvature in a lateral and downward direction away from a main bore in a subsurface formation wherein a whipstock assembly is disposed at the lower end of a casing having a curved guide surface and a drill bit at the lower end of a drill string is advanced along the whipstock guide surface to form the drainhole, the improvement comprising the steps of orienting the curved guide surface of the whipstock in a compass direction at a correction angle to compensate for lateral deviation of the main bore from vertical and helixing of said drill bit as it is advanced beyond said whipstock in forming a lateral bore, and anchoring said curved guide surface whereby advancement of said drill bit along said curved guide surface will intersect a predetermined location along the desired azimuth.

7. In the method according to claim 6 in which the correction angle of the whipstock curved guide surface is increased in direct relation to increases in the radius of curvature of the guide surface for a given angle of lateral deviation of the main bore.

8. In the method according to claim 6 wherein the actual drilled depth of the drainhole is corrected further by the in-line component of deviation of the main bore from vertical.

9. A whipstock assembly adaptable for use in drilling a drainhole in a lateral direction away from a main, substantially vertical bore in which said main bore has a lateral deviation away from the desired azimuth of the drainhole, said whipstock assembly comprising:

an elongated body provided with a curved guide surface extending in the longitudinal direction of said body and forming a concave face therein with lateral wings on opposite sides of said curved guide surface, said curved guide surface having a radius of curvature corresponding to a preselected radius of curvature for said drainhole and diverging downwardly from an upper tapered end portion;

a tubular portion extending above said upper tapered end portion of said main body in coaxial relation to said main body; and means for anchoring said whipstock assembly at a predetermined angle to compensate for the lateral deviation of said main bore away from vertical whereby to guide the advancement of a drill bit and drill string along a course in forming a drainhole which will intersect a predetermined location on the desired azimuth.

10. A whipstock assembly according to claim 9, wherein said curved guide surface is formed with lateral wings extending continuously along opposite sides of the face of said curved guide surface.

11. A whipstock assembly according to claim 9, said curved guide surface having a concave face with a radius of curvature corresponding substantially to the radius of said tubular portion.

12. The method of directionally drilling a bore in a lateral, downwardly curved direction away from a substantially vertical main bore in a subsurface formation, comprising the steps of:

determining the deviation of the main bore from vertical;

positioning a drill string in the main bore having a whipstock with a curved guide surface at the lower end of said drill string, said curved guide surface having a radius of curvature in a longitudinal direction corresponding to the radius of curvature of the lateral bore to be formed and having a concave face in a transverse direction;

compensating for the helixing component of a drill bit advanced along said whipstock in forming said lateral bore;

orienting said whipstock to compensate for lateral deviation of the main bore away from the desired azimuth of said lateral bore and said helixing component of a drill bit as it is advanced beyond said whipstock in forming said lateral bore, followed by advancing a drill bit along the curved guide surface to drill the lateral bore along the predetermined radius of curvature.

13. The method according to claim 12, wherein the curvature of the concave face of the guide surface in a transverse direction corresponds to the radius of curvature of the drill string.

14. The method according to claim 13, characterized by drilling from the main bore for a vertical distance corrected by the in-line component of deviation of the main bore from vertical.

15. In the method according to claim 1 in which the correction angle of the whipstock curved guide surface is increased in direct relation to increases in the radius of curvature of the guide surface for a given angle of lateral deviation of the main bore.

* * * * *

UNITED STATES PATENT AND TRADEMARK OFFICE

CERTIFICATE OF CORRECTION

PATENT NO. : 4,420,049

DATED : December 13, 1983

INVENTOR(S) : Don R. Holbert

It is certified that error appears in the above—identified patent and that said Letters Patent is hereby corrected as shown below:

Column 1, line 28, cancel "whipstock" and substitute -- whipstocks --.

Column 1, line 45, cancel "of" and substitute -- or --.

Column 2, line 2, cancel "of" (second occurrence) and substitute -- or --.

Column 6, line 26, after "whipstock" insert -- guide --.

Column 10, line 16, cancel "commputational" and substitute -- computational --.

Signed and Sealed this

*Fifteenth* Day of *May 1984*

[SEAL]

*Attest:*

GERALD J. MOSSINGHOFF

*Attesting Officer*

*Commissioner of Patents and Trademarks*